US009522818B2

(12) United States Patent
Clüsserath et al.

(10) Patent No.: US 9,522,818 B2
(45) Date of Patent: Dec. 20, 2016

(54) FILLING MACHINE

(71) Applicant: KHS GmbH, Dortmund (DE)

(72) Inventors: Ludwig Clüsserath, Bad Kreuznach (DE); Bernd Bruch, Weinsheim (DE)

(73) Assignee: KHS GmbH, Dortmund (DE)

( * ) Notice: Subject to any disclaimer, the term of this patent is extended or adjusted under 35 U.S.C. 154(b) by 75 days.

(21) Appl. No.: 14/431,897

(22) PCT Filed: Sep. 26, 2013

(86) PCT No.: PCT/EP2013/002889

§ 371 (c)(1),
(2) Date: Mar. 27, 2015

(87) PCT Pub. No.: WO2014/048569

PCT Pub. Date: Apr. 3, 2014

(65) Prior Publication Data

US 2015/0239722 A1 Aug. 27, 2015

(30) Foreign Application Priority Data

Sep. 28, 2012 (DE) ..... 10 2012 019 161

(51) Int. Cl.

| | |
|---|---|
| ***B67C 3/00*** | (2006.01) |
| ***B67C 3/02*** | (2006.01) |
| ***B67C 3/22*** | (2006.01) |
| *B67C 3/26* | (2006.01) |

(52) U.S. Cl.

CPC ..... *B67C 3/004* (2013.01); *B67C 3/02* (2013.01); *B67C 3/225* (2013.01); *B67C 2003/228* (2013.01); *B67C 2003/2694* (2013.01)

(58) Field of Classification Search

CPC ..... B67C 3/02; B67C 3/004; B67C 3/225; B67C 2003/228; B67C 2003/2694

USPC ..... 141/89, 90, 91, 92, 93

See application file for complete search history.

(56) References Cited

FOREIGN PATENT DOCUMENTS

| | | |
|---|---|---|
| DE | 698 15 475 | 5/2004 |
| DE | 10 2004 004 331 | 9/2005 |
| DE | 10 2006 017706 | 10/2007 |
| EP | 0 554 951 | 8/1993 |
| EP | 2 103 564 | 9/2009 |
| EP | 2 354 080 | 8/2011 |
| EP | 2 368 835 | 9/2011 |
| JP | H06 336288 | 12/1994 |
| JP | 2004 001850 | 1/2004 |
| WO | WO2007/019590 | 2/2007 |

(Continued)

*Primary Examiner* — Timothy L Maust
*Assistant Examiner* — Andrew Schmid
(74) *Attorney, Agent, or Firm* — Occhiuti & Rohlicek LLP

(57) ABSTRACT

A container-filling machine includes a rotor, a machine rack that doesn't move with the rotor, filling positions formed on the rotor, rinsing-cap elements used during CIP cleaning, each associated with a filling position, and a housing that isolates filling positions during aseptic filling. Each rinsing-cap element includes a rinsing cap at one end and a connection at the other. An outflow channel extends between the ends. The rinsing-cap element moves from a first position, in which it is outside a space occupied by a container being filling, and a second position, in which it lies sealed against a filling element. In the second position, the rinsing-cap element and the outflow channel connect to a fixed discharge on the machine rack. Each rinsing cap element moves between the first and second position by swiveling a swiveling element about an axis thereof between the two positions.

17 Claims, 7 Drawing Sheets

(56) References Cited

FOREIGN PATENT DOCUMENTS

| | | |
|---|---|---|
| WO | WO2010/018850 | 2/2010 |
| WO | WO2013/167219 | 11/2013 |

FILLING MACHINE

RELATED APPLICATIONS

This application is the U.S. National Stage under 35 USC 371 of international application PCT/EP2013/002889, filed on Sep. 26, 2013, which claims the benefit of the Sep. 28, 2012 priority date of German application DE 10 2012 019 161.8, the contents of which are herein incorporated by reference.

FIELD OF INVENTION

The invention relates to filling machines, and in particular, to filling machines for aseptic free-jet filling of containers.

BACKGROUND

Known filling machines for filling bottles or similar containers with a liquid filling material typically include a rotor having a plurality of filling positions, each having one filling element. The filling positions are disposed on the rotor so that they rotate with the rotor about a vertical machine axis.

Filling machines of this type require periodic cleaning. To achieve this, a cleaning assembly is provided on the machine rack of the filling machine. This machine rack does not rotate with the rotor. The cleaning assembly has two arched pipe sections. Rinsing caps protrude above upper faces of the pipe sections.

A lifting device moves the pipe sections, with their rinsing caps, between a starting position and a working-and-rinsing position. In the starting position, the pipe sections and the rinsing caps are located to the side of the transport element and above the filling positions. In the working-and-rinsing position, the rinsing caps, following a delivery from below, lie in a sealed position against, in each case, one filling element. This known filling machine is structurally costly. Additionally, it is not suitable for aseptic filling of containers.

Also known are filling machines in which a linear transport section moves containers to be filled past filling elements or dispensing nozzles.

A cleaning device for cleaning the dispensing nozzles in these types of machines has an adapter that can be axially shifted between a starting position and a working-or-rinsing position.

In the starting position, during container-filling, the cleaning device is outside the trajectory of the containers. In the working-or-rinsing position, a guide with an actuation device guides the cleaning device. This filling machine is structurally costly because of the devices for cleaning the dispensing nozzles. It also has numerous angled areas or surfaces on which foreign substances or germs can accumulate. This makes it unsuitable for aseptic filling.

Another known filling machine has rinsing caps on the rotor of the filling machine. These rinsing caps connect to a return flow or drainage channel for draining away sterilizing medium. A common ring that concentrically encloses the machine axis defines a drainage channel. Rotating or swiveling this common ring brings the rinsing caps, each of which is assigned to a filling element, from a starting position to a working position.

In the starting position, the caps are outside the filling elements and the containers to be filled during the filling operation. In the working position, each rinsing cap is brought into a sealed position against the filling element associated with it. In this sealed position, it forms a rinsing space or rinsing channel that is sealed to the outside and that encloses at least the dispensing opening of the filling element. Sterilization medium then flows through the rinsing space thus formed.

A disadvantage of this type of cleaning system is that the resulting dense population of rinsing caps restricts structural freedom and imposes undesirable design constraints.

Also known are rotating filling machines for aseptic filling of bottles or other containers with a free-jet of liquid filling material. To avoid contamination of the filling material during the filling, such filling machines have a housing, or isolator, that forms an isolator chamber through which the filling positions and the empty containers move during the filling process.

A disadvantage of this kind of filling machine is that both the filling elements and the isolator chamber must be cleaned. This makes it necessary to avoid having stray droplets of cleaning medium collecting in areas inside the isolator chamber.

Another problem that arises in this kind of filling machine is that the drives for moving the rinsing caps between their starting position and working position are arranged inside the isolator chamber. This creates numerous additional surfaces that form angled areas where leftover sterilization medium can accumulate.

SUMMARY OF THE INVENTION

The invention provides a filling machine having a simplified structural design with a high level of operating reliability and that promotes reliable cleaning of the filling machine and its filling elements.

In one aspect, the invention includes a container-filling machine for filling a container with liquid filling. Such a container-filling machine includes a rotor that can be driven to rotate about a machine axis, a machine rack that does not move with the rotor, filling positions, each having a dispensing opening, the filling positions being formed on the rotor, rinsing-cap elements used during CIP cleaning, each one being associated with a filling position, and a housing in which, during aseptic filling, the filling positions are disposed so that they are isolated from the environment. Each rinsing-cap element includes a first end, a second end, an outflow channel, and a swiveling element. The first end of the rinsing-cap element includes a rinsing cap, and the second end of the rinsing-cap element includes a connection. The outflow channel connects to the rinsing cap at the first end, extends between the first and the second end, and is open at the second end. The rinsing-cap element is movable between a first position, in which it is disposed outside a space occupied by a container during filling thereof, and a second position, in which it lies against a filling element in a sealed position in an area of a dispensing opening thereof. In the second position, the rinsing-cap element and the outflow channel connect to a fixed discharge provided on the machine rack. Each of the rinsing cap elements is movable between the first and second position by swiveling the swiveling element about a swivel-element axis thereof between the first and second positions.

Some embodiments include plural first couplings, each of which is associated with a rinsing-cap element. Each first coupling is disposed on either the machine rack or the rotor. During CIP cleaning, each first coupling connects the connector of its associated rinsing-cap element to a fixed discharge. Among these embodiments are those in which the first coupling is coupled to the connector of the rinsing-cap element by swiveling the rinsing-cap element into the second position to make a flow connection, and those in which the rinsing-cap element is permanently connected to the first coupling, and is configured to swivel on the first coupling about a vertical swivel-element axis.

Also among the embodiments that include a first coupling are those that have a collector channel formed on either the rotor or the machine rack. In the second position, the collector channel, the first couplings and the outflow channels of the rinsing-cap elements are connected, and the connector channel connects to a fixed discharge during CIP cleaning.

Other embodiments that have a first coupling are those in which a ring encloses the machine axis. In these embodiments, the first coupling is one of many identical first couplings on different filling elements. These first couplings are either disposed on the ring or formed by the ring.

Other embodiments that have first couplings also have second couplings. During CIP cleaning, the second couplings connect the first couplings to the fixed discharge. The second couplings swivel between an ineffective position and a working position. In the ineffective position, the second couplings are outside of a movement space of the first couplings that are moved with the rotor. In the working position, the second couplings are connected to the first couplings and to the fixed discharge.

Some embodiments further include, on the swiveling element, a container carrier that suspends the container.

In other embodiments, the rinsing-cap element includes a pipe section that includes the outflow channel. In these embodiments, the rinsing cap and the connector are formed on opposite areas of a circumferential wall of the rinsing-cap element.

Embodiments also include those in which the rinsing-cap elements are disposed to rotate with the rotor, and those in which they are disposed on the machine rack.

Also included are embodiments in which a container carrier on the swiveling element suspends the container.

In some embodiments, the swiveling element includes a bolt. However, there are also embodiments in which the swiveling element includes a rod.

In additional embodiments, each of the rinsing-cap elements is configured to swivel about the swivel axis such that in the second position, a longitudinal extension of the rinsing-cap element extends radially from the machine axis.

Yet other embodiments include a container carrier that swivels with the rinsing-cap element. In these embodiments, the container carrier swivels between an effective position and an ineffective position, wherein in the effective position, the container carrier holds a container.

As used herein, "container" includes cans, bottles, tubes, pouches, in each case made of metal, glass and/or plastic, and other packages that are suitable for filling with liquid or viscous products.

As used herein, "free-jet filling" means a process in which liquid filling material flows into a container that does not lie with its mouth or opening against the filling element, but that instead lies at a distance from the filling element or from a filling material outlet at the filling element.

As used herein, the expression "substantially" or "approximately" means deviations from exact values in each case by ±10%, preferably by ±5%, and/or deviations in the form of changes not significant for function.

As used herein, "cleaning medium" refers to a cleaning and/or sterilizing medium, which can be liquid, gaseous, or a mixture of liquid and gas.

As used herein, "cleaning" includes cleaning and/or sterilization.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

These and other features and advantages of the invention will be apparent upon inspection of the following detailed description and the accompanying drawings, in which.

DETAILED DESCRIPTION

Figure 1:
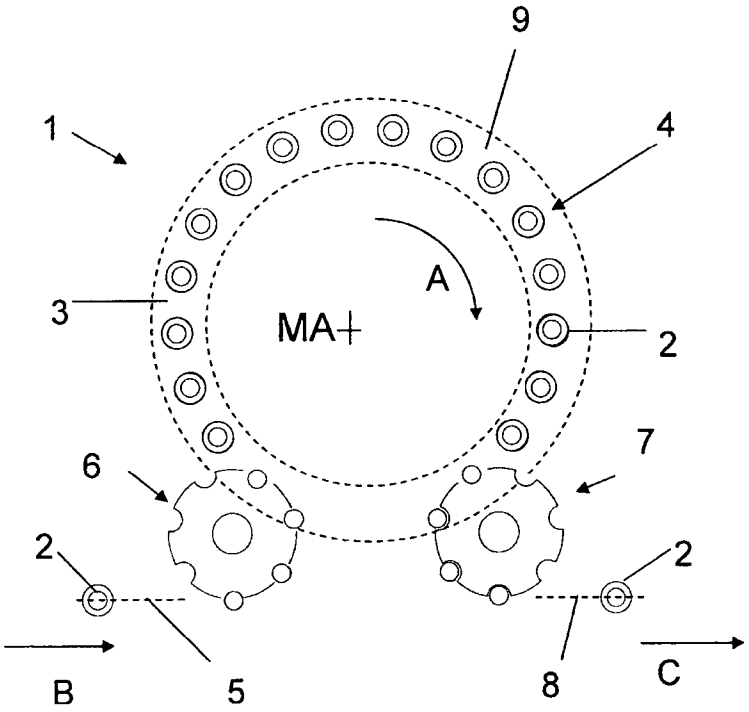
FIG. 1 is a schematic representation from above of a rotating filling machine for aseptic free-jet filling of bottles with a liquid filling material.

Referring to FIG. 1, a rotating filling machine 1 for aseptic free-jet filling of containers 2, and in particular, bottles, with a liquid filling material has a rotor 3 that can rotate in a rotation direction A about a vertical machine axis MA so that it functions as a transport element. A plurality of filling positions 4 is formed on the circumference of this rotor 3. These filling positions 4 are distributed at regular angular distances around the machine axis MA and at the same radial distance from the machine axis MA. In other words, if a polar coordinate system is defined with the machine axis MA at the origin, the filling positions 4 are located at $(r, n\Delta\theta)$ where $n=0, 1, 2 \ldots$.

An external conveyor 5 transports empty containers 2 along an inflow direction B towards a container inlet 6, where they are transferred to respective filling positions 4. At a container outlet 7, an external conveyor 8 removes filled containers 2 from the filling positions 4 and transports them in an outflow direction C to a further handling stage. As they are transported by the rotor 3 around an angular range between the container inlet 6 and the container outlet 7, the filling positions 4 and the containers 2 provided on it move through a housing 9 that isolates them from the environment. The volume of the housing 9 is kept as small as possible.

Figure 2:
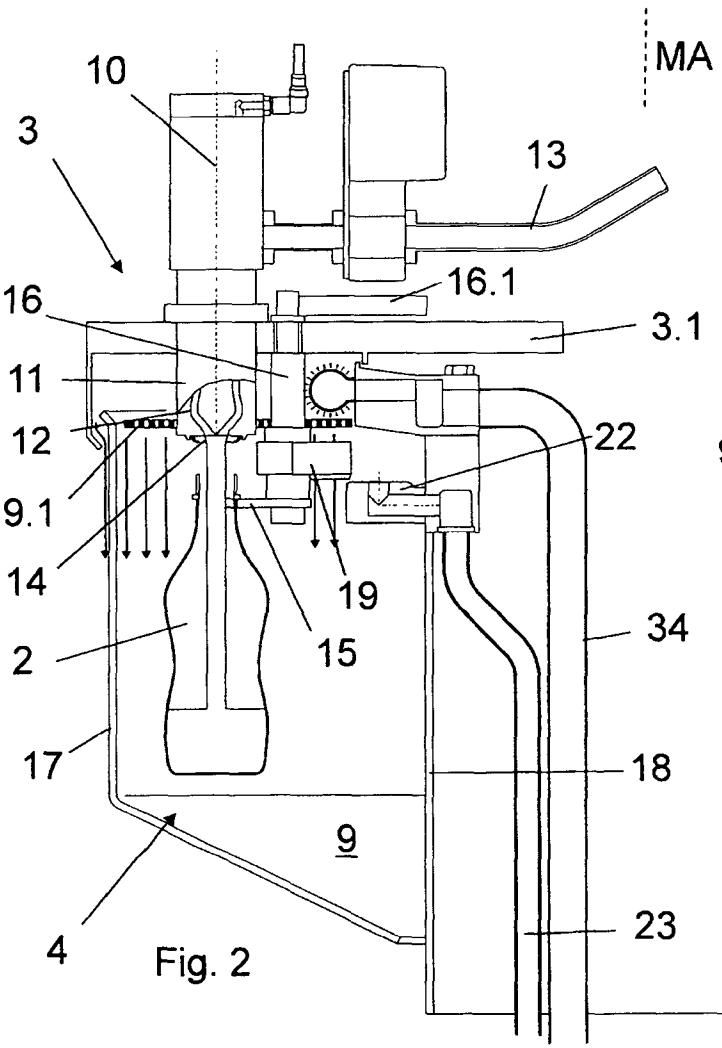
FIG. 2 is a schematic partial representation, in section, of a filling position of the filling machine in FIG. 1 together with a housing that isolates the containers during the filling operation.

FIG. 2 shows details of a typical filling position 4 in the housing 9. The filling position 4 includes a filling element 10 that is arranged on the circumference of the rotor 3 or on the circumference of a rotor element 3.1. The filling element 10 is far enough above the rotor element 3.1 so that only a filling nozzle 11 of the filling element 10 protrudes beyond the underside of the rotor element 3.1 and into the housing 9. In the illustrated embodiment, the rotor element 3.1 is a disc that lies with its upper face and underside on levels that define planes perpendicular to the machine axis MA.

The filling element 10 has a liquid channel 12. A product pipe 13 connects a top end of this liquid channel 12 to a filling material tank on the rotor 3. The filling material tank is common to all the filling elements 10 of the filling machine 1.

At the lower end of the filling nozzle 11, the filling element 10 forms a dispensing opening 14, or filling-material outlet. During filling, liquid filling material flows in a free jet from the dispensing opening 14, through a container opening, and into a container 2. A liquid valve inside the liquid channel 12 controls how much filling material enters the containers 2.

Underneath each filling nozzle 11 of each filling position 4 is a container carrier 15 that is provided on a bolt 16. The bolt 16 extends through the rotor element 3.1 parallel to the machine axis MA along a bolt-axis. The container carrier 15 is configured so that it can swivel about this bolt axis.

A swivel lever 16.1 is provided on the upper face of the rotor element 3.1. This swivel lever 16.1 connects to the bolt 16 so that turning the swivel lever 16.1 will swivel the bolt 16. Swiveling the bolt 16 transitions the container carrier 15 between an effective position and an ineffective position. In the effective position, the container carrier 15 holds the container 2 underneath the filling element 10. In the ineffective position, the container carrier 15 is located radially to the machine axis MA to the side of the filling element 10.

In the illustrated embodiment, an outer wall 17 and an inner wall 18 form the housing 9. The inner wall 18 is closer to the machine axis MA than the outer wall 17. The outer wall 17 is connected to the rotor element 3.1. The inner wall 18 is provided on a machine rack that does not rotate with the rotor 3.

Figure 3:
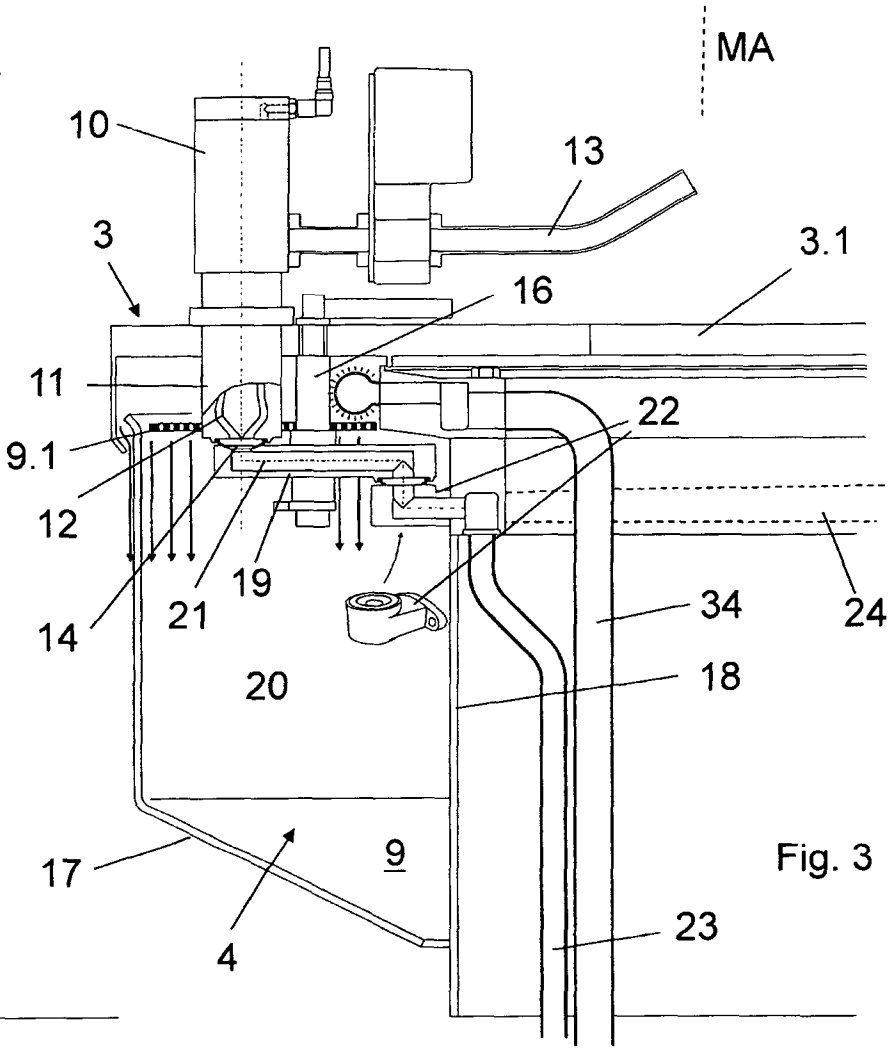
FIG. 3 shows the filling position of FIG. 2 reconfigured for cleaning the filling machine with a cleaning medium, e.g. during CIP cleaning.

In FIG. 2, the filling position 4 is in an operating state for the free-jet filling of a container 2 that is suspended from its neck ring on the container carrier 15 and held in the housing 9. FIG. 3 shows the same filling position 4 in a cleaning state, which is discussed in more detail below.

FIG. 3 shows the filling position 4 reconfigured for CIP cleaning of the filling machine 1 and in particular also its filling elements 10 with the rotor 3 being stationary. In this configuration, it is essential to equip the filling elements 10 in the area of their dispensing opening 14 with a rinsing cap formed on a rinsing-cap element 19 as described below so that cleaning medium flows through critical channels inside each filling element 10. Cleaning medium flows from the dispensing opening 14, enters the rinsing cap, and drains from it.

Figure 4:
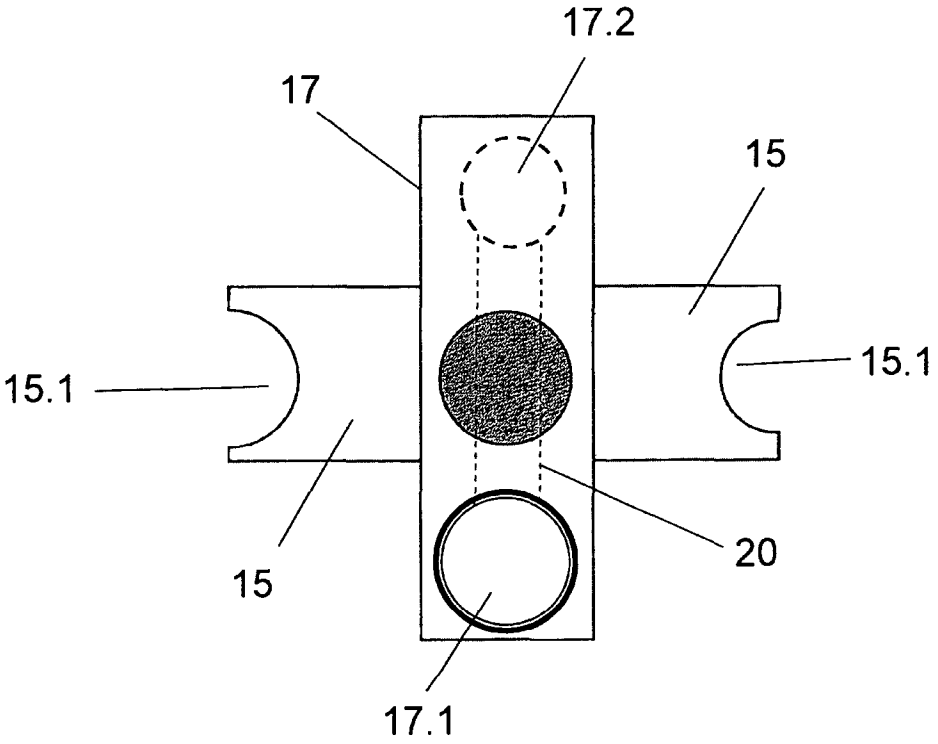
FIG. 4 is a simplified representation of a view from above a rinsing-cap element and a container carrier arranged underneath the rinsing-cap element.

To close the filling elements 4 at their dispensing openings 14 and to drain the CIP cleaning medium, each filling position is assigned a rinsing-cap element 19 that forms the rinsing cap. The rinsing-cap element 19 comprises a pipe section 21 that forms an outflow channel 20. An axis of that outflow channel 20 lies on a level perpendicular or substantially perpendicular to the machine axis MA. An upper face of one end of the pipe section 21 forms the rinsing cap. An underside of the other end of the pipe section 21 forms a connection, as shown in FIG. 4.

Between the two ends, the rinsing-cap element 19 is secured on the bolt 16. This allows the bolt 16 to swivel the rinsing-cap element 19 between an ineffective position, shown in FIG. 2 and a rinsing-or-working position, shown in FIG. 3.

In the ineffective position, the rinsing-cap element 19 or its pipe section 21 is oriented tangentially to the circular movement of the rotor 3 and the container carrier 15 is located as illustrated in FIG. 2.

In the rinsing-or-working position, illustrated in FIG. 3, the rinsing-cap element 19 is arranged with its longitudinal extension oriented radial to the machine axis MA. A first end of the rinsing-cap element 19 forms a rinsing cap. This rinsing cap lies in a sealed position against the filling element 10 in the area of its dispensing opening 14. A second end of the rinsing-cap element 19 forms a connection to a coupling 22. This coupling 22 is provided on a machine rack that does not rotate with the rotor 3. At least one fixed vertical discharge 23, i.e. a discharge that does not rotate with the rotor 3, is connected to the coupling 22.

In the embodiment of FIGS. 2 and 3, an annular collector channel 24 on the machine rack concentrically encloses the machine axis MA. The couplings 22 are connected to an annular collector channel 24 in the direction of flow, as seen in FIG. 3. Preferably, more than one fixed vertical discharge 23 connects to the annular collector channel 24.

The number of couplings 22 is the same as the number of filling positions 4 and the number of filling elements 10. The couplings 22 are arranged at the same angular distance around the machine axis MA as the filling elements 10 and, relative to the machine axis MA, radially within the circular trajectory on which the filling elements 10 or their vertical axes move when the rotor 3 is rotating.

FIG. 4 shows a view from above the rinsing-cap element 19. In the figure, one can see the bolt 16 and also a container carrier 15 arranged underneath the rinsing-cap element 19. The container carrier 15 is preferably, as shown in FIG. 4, made wing-like in the same way as the rinsing-cap element 19. First and second ends of the container carrier 15 protrude radially from the bolt 16. The first and second ends of the container carrier 15 have corresponding first and second container holders 15.1 of different sizes. As a result, the same filling machine 1 can process containers 2 with different neck diameters.

Figure 5:
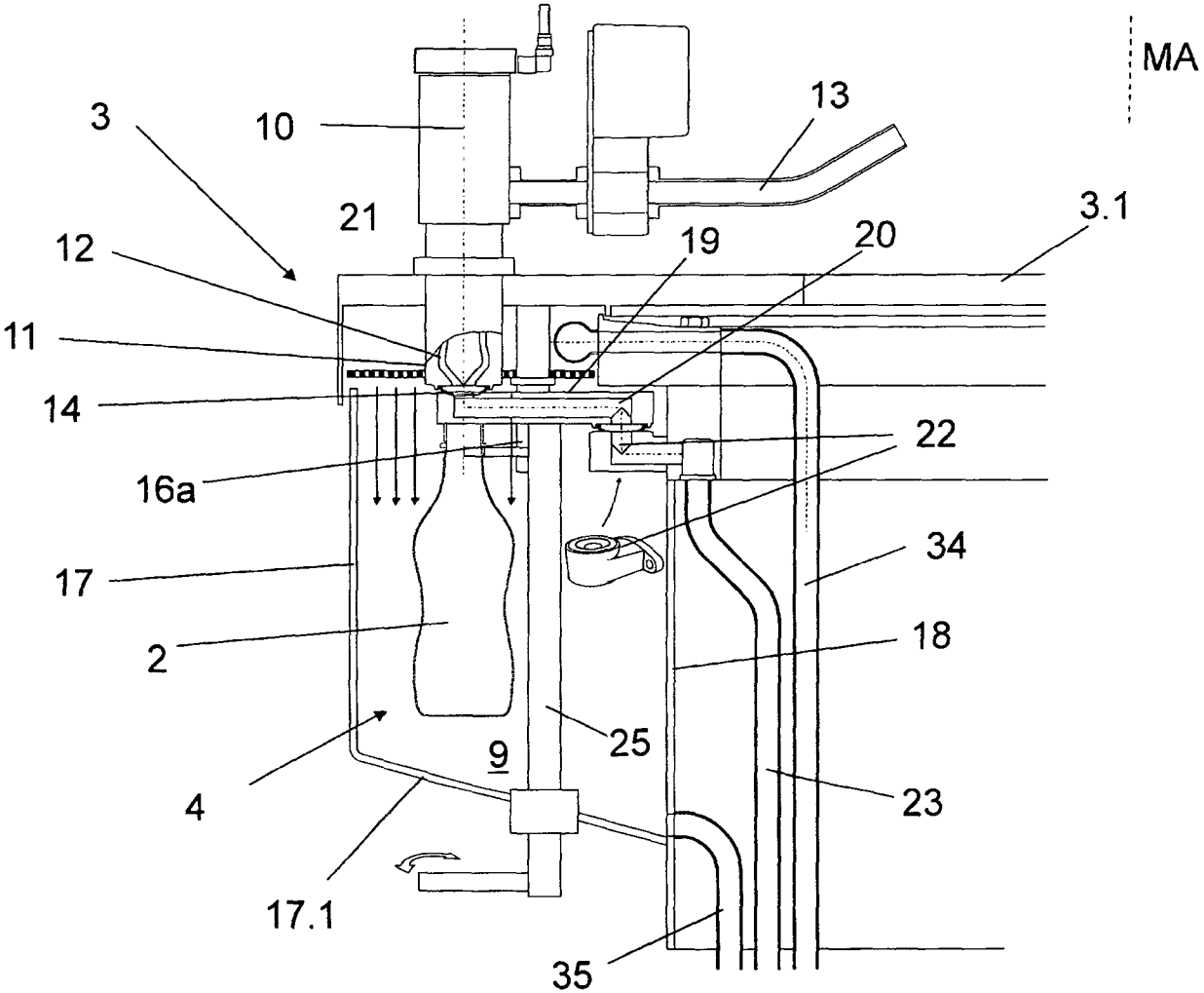
FIG. 5 is a representation similar to that shown in FIG. 3 of a further embodiment of the invention.

FIG. 5 shows another embodiment of a filling position 4. In this embodiment, inner and outer walls 17, 18 forming the housing 9 are part of a machine rack. Like the machine racks in other embodiments, this machine rack does not rotate with the rotor 3. A slanting section 17.1 of the wall 17 forms a slanting floor of the housing 9. A rod 25 having an axis oriented parallel to the machine axis MA is mounted such that it can swivel. The rod 25 has an upper end arranged within the housing 9. It is at this upper end that the rod 25 supports the rinsing cap element 19.

In the filling-or-working position illustrated in FIG. 5, the rinsing-cap element 19 lies with its rinsing cap in a sealed position against the filling element 1 in the area of the dispensing opening 14. The rinsing-cap element 19 is also connected, by its connector, to the coupling 22. In this embodiment, the rinsing-cap element 19 causes a fluid connection between the dispensing opening 14, the filling element 10, and the fixed vertical discharge 23, thus allowing drainage of the cleaning medium. Furthermore, in this embodiment, the collector channel 24 can be provided on the machine rack with a plurality of fixed vertical discharges 23.

Figure 7:
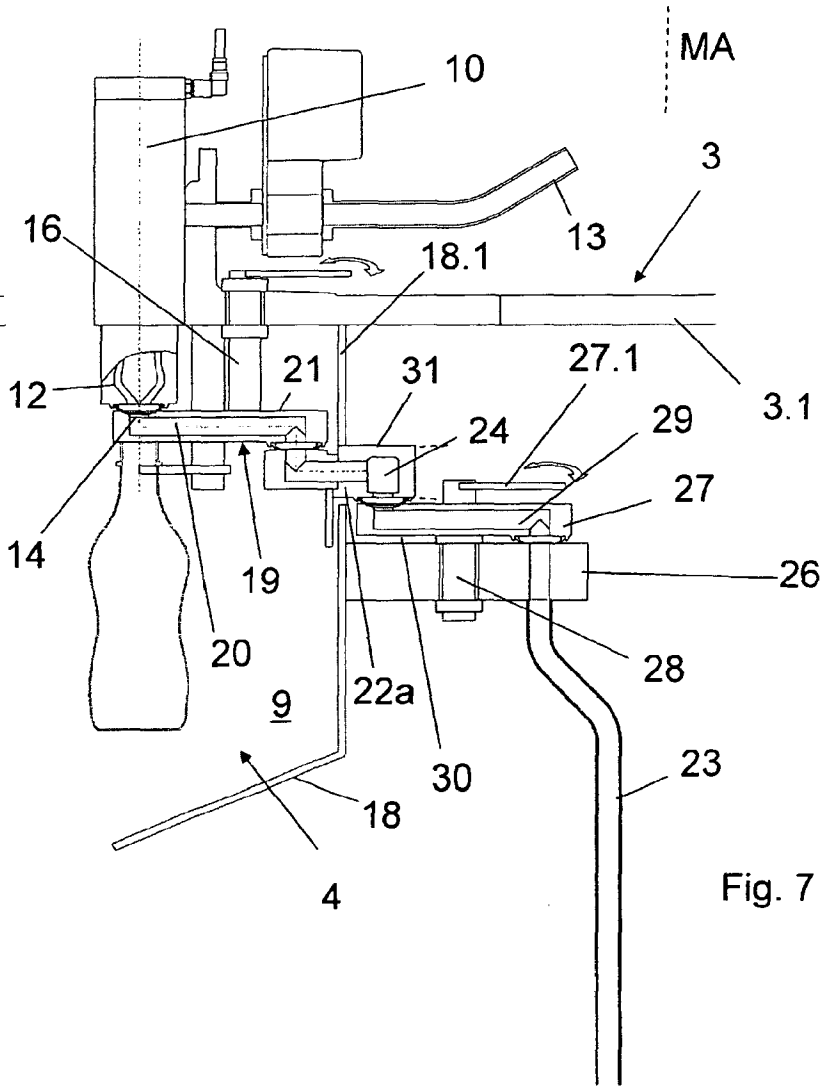
FIGS. 6 and 7 are representations similar to FIGS. 2 and 3 of a further embodiment of the invention.
Figure 6:
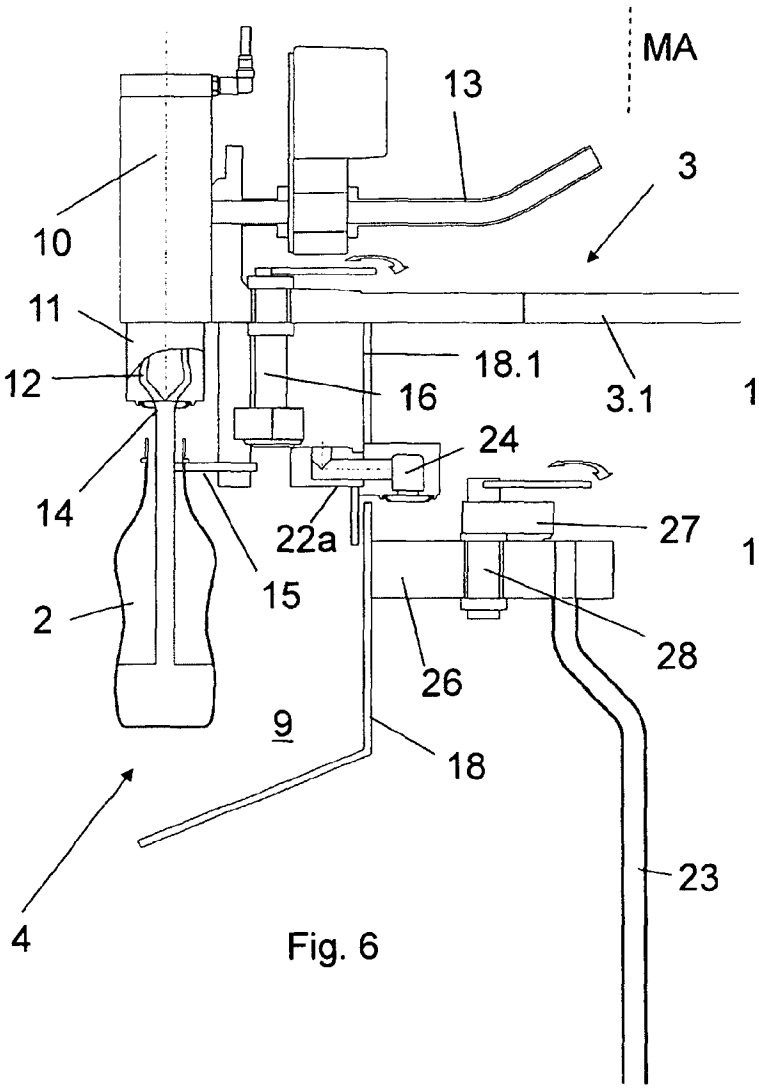

FIG. 6 shows another embodiment of a filling position 4 in filling mode. FIG. 7 shows the same embodiment in a cleaning-and-disinfection mode. In this embodiment, an independent rinsing-cap element 19 is assigned to each filling element 10. The rinsing-cap element 19 is held on the bolt 16 and mounted such that it can swivel relative to the rotor element 3.1.

In the embodiment of FIGS. 2 and 3, the bolt 16 connects to the rinsing-cap element 19 substantially halfway between the two ends of the rinsing-cap element 19. In contrast, in the embodiment illustrated in FIGS. 6 and 7, the rinsing-cap element 19 is secured non-centrally on the lower end and extends into the housing 9 in such a manner that the end forming the rinsing cap is at a greater distance from the bolt 16 than the other end.

Instead of the couplings 22 used in FIGS. 2 and 3, which are displaced from the wall, the embodiment of FIGS. 6 and 7 uses couplings 22*a* at a wall section 18.1 of the housing 9 connected to the rotor 3 or rotor element 3.1. An independent coupling 22*a* is assigned to each filling element 10, with the couplings 22*a* being distributed at the same angular distance around the machine axis MA as the filling elements 10. On the machine rack, which does not rotate with the rotor 3, coupling elements 27 are provided on a carrier ring 26 that concentrically encloses the machine axis MA. Each coupling element is on a bolt 28 that can swivel in the carrier ring 26 about an axis parallel to the vertical machine axis MA in response to moving a lever 27.1. The coupling elements 27 are structurally similar to the rinsing-cap elements 19. Each coupling element 27 features a pipe section 30 having a fluid channel 29. The pipe section 30, which is sealed at both ends, is arranged with the axis of its channel 29 on a level perpendicular to or substantially perpendicular to the machine axis MA. The pipe section 30 has a connection opening at a first end 30.1 on an upper face thereof and a connection opening at the second end 30.2 on its underside.

During the filling operation, as shown in FIG. 6, both the rinsing-cap element 19 and the additional coupling element 27 are swiveled into an ineffective position in which the longitudinal extensions of these elements are oriented tangentially relative to the rotation direction A of the rotor 3.

During CIP cleaning, which once again is carried out with the rotor 3 stationary, both the rinsing-cap element 19 and the coupling element 27 are swiveled into an effective position, or working position. In the working position, the coupling 22*a* connects the rinsing-cap element 19 or the dispensing opening 14 of its corresponding filling element 10 to the fixed vertical discharge 23. The number of coupling elements 27 is the same as the number of couplings 22*a* or filling positions 4. The coupling elements 27 are likewise distributed at the same angular distance around the machine axis MA as the couplings 22*a* and the filling elements 10.

The couplings 22*a* are preferably part of a ring 31 that concentrically encloses the machine axis MA and that rotates with the rotor 3. The collector channel 24 is formed in the ring 31. The collector channel 24 rotates with the rotor 3. Couplings 22*a* are connected to the collector channel 24.

Figure 9:
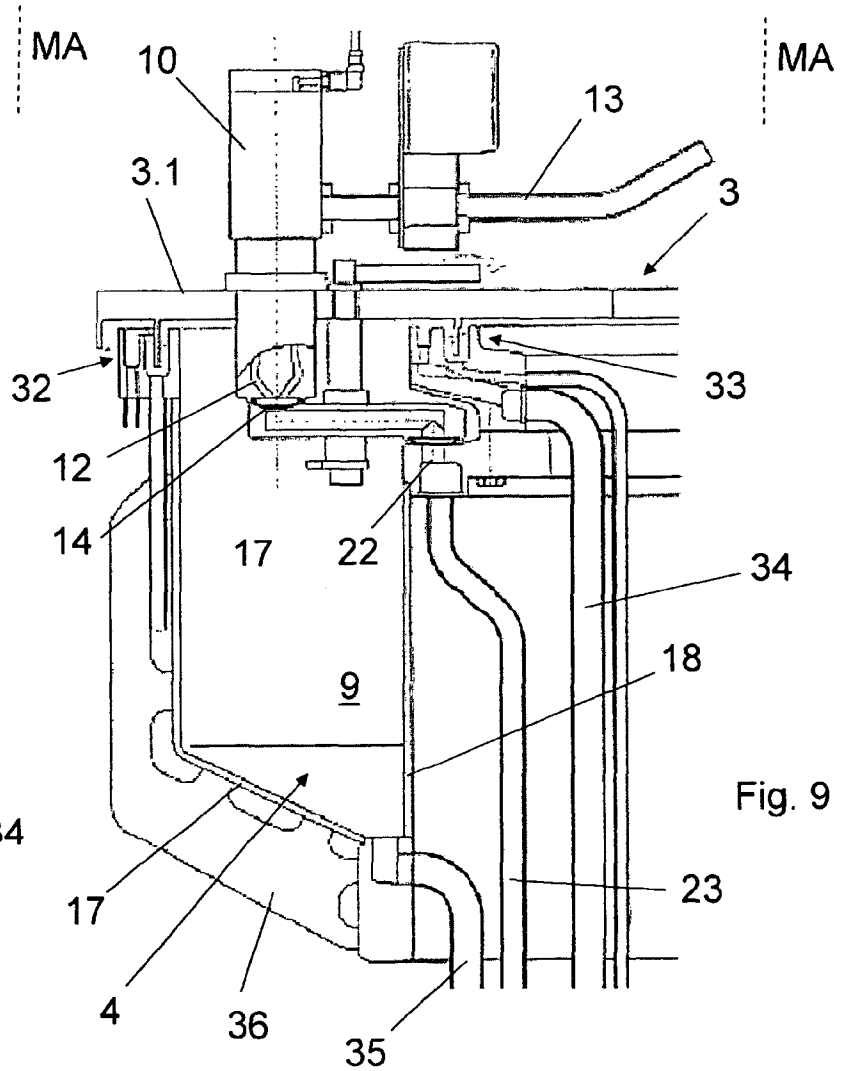
FIGS. 8 and 9 are representations similar to FIGS. 2 and 3 of yet a further embodiment of the invention.
Figure 8:
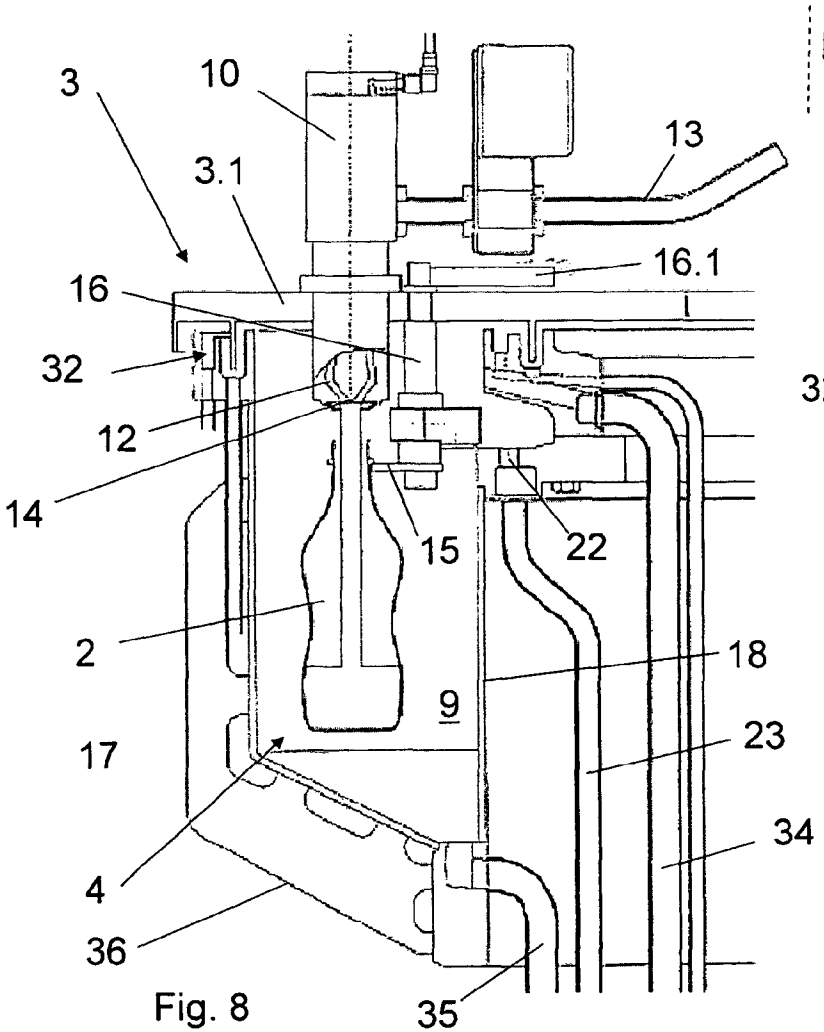

FIGS. 8 and 9 show another embodiment that is similar to that shown in FIGS. 2 and 3 but with the walls 17, 18 forming the housing 9 being provided on a machine rack that does not rotate with the rotor 3. Additionally, a circular siphon seal 32, 33 that encloses the machine axis MA seals a transition between the inner and outer walls 17, 18 and the underside of the rotor element 3.1. As was the case with FIGS. 2 and 3, FIG. 8 shows the embodiment in a filling mode, and FIG. 9 shows the same embodiment in a cleaning mode.

An annular channel open at the top and filled with a sterile liquid forms the siphon seals 32, 33, on the top end of the wall 17, 18. An annular wall section protruding over the underside of the rotor element 3.1 and concentrically enclosing the machine axis MA extends into this annular channel.

In all the embodiments described, a pipe 34 on the machine rack supplies the housing 9 with sterile medium during both the filling operation and during CIP cleaning. A suitable sterile medium is sterile air. The sterile medium is supplied to a distribution space at the upper face of the housing and then reaches the housing 9 preferably through a wall 9.1. Preferably, it does so through a wall having a plurality of openings distributed in it, as shown in FIGS. 2 and 3. A fixed discharge 25 drains liquid media out of the housing 9. A number of reinforcing panels 36 distributed around the machine axis MA reinforce the housing 9.

Figure 10:
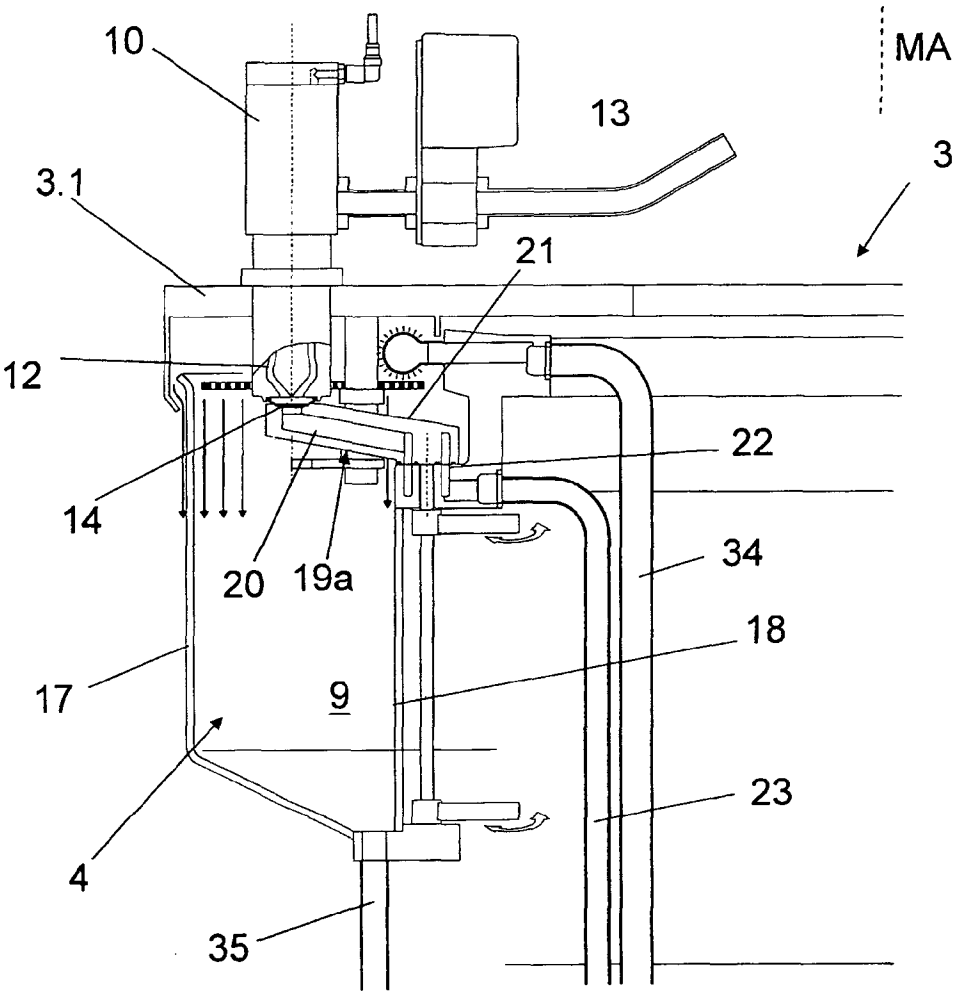
FIG. 10 is a representation similar to that shown in FIG. 5 of a further embodiment of the invention.

FIG. 10 shows a filling position 4 in operating mode for CIP cleaning in yet another embodiment. In this embodiment, a rinsing-cap element 19*a* corresponding to the rinsing-cap element 19 is assigned to each filling element 1. The rinsing-cap element 19*a* differs from the rinsing-cap element 19 substantially only in that the rinsing-cap element 19*a* is arranged diagonally, i.e. with its longitudinal extension slanting downward, thus defining an acute angle between the longitudinal extension and a level that defines a plane perpendicular to the machine axis MA. The acute angle opens radially outwards relative to the machine axis MA when the rinsing-cap element 19 is in the working-or-rinsing position.

The rinsing-cap element 19 is connected permanently to the coupling 22 and, on this coupling 22, can swivel about a vertical axis. The rinsing-cap element 19 can thus be swiveled by a lever 37 between an ineffective position and the position illustrated in FIG. 10. In this embodiment, the rinsing-cap elements are provided on a machine rack that does not rotate with the rotor 3, but that, during the CIP cleaning, connects the particular filling element 10 to the fixed vertical discharge 23.

The invention has been described above using examples of embodiments. It is clear that numerous modifications and variations are possible without thereby departing from the inventive idea underlying the invention.

The invention claimed is:

1. An apparatus comprising a container-filling machine for filling a container with liquid filling, said container-filling machine comprising a housing, a rotor that is drivable to rotate about a machine axis, a machine rack that does not move with said rotor, filling positions formed on said rotor, said filling positions being disposed in said housing during aseptic filling for isolation thereof from the environment, each filling position comprising a dispensing opening, and rinsing-cap elements configured for use during CIP cleaning, each rinsing-cap element being associated with a corresponding one of said filling positions and comprising a swiveling element, a first end that comprises a rinsing cap, a second end that comprises a connection, and an outflow channel that connects to said rinsing cap at said first end, extends between said first and second ends, and is open at said second end, wherein each of said rinsing-cap elements is movable between a first position, in which said rinsing-cap element is disposed outside a space occupied by a container during filling thereof, and a second position, in which said rinsing-cap lies against a filling element in a sealed position in an area of a dispensing opening thereof, said second position being a working-and-rinsing position in which said rinsing-cap element and said outflow channel connect to a fixed discharge provided on said machine rack, and wherein each of said rinsing cap elements is movable between said first and second position by swiveling said swiveling element about a swivel-element axis thereof between said first and second positions.

2. The apparatus of claim 1, wherein each rinsing-cap element has an associated first coupling that is disposed on one of said machine rack and said rotor, wherein, during CIP cleaning, said first coupling connects said connector of said rinsing-cap element to a fixed discharge.

3. The apparatus of claim 2, wherein said first coupling is coupled to said connector of said rinsing-cap element by swiveling said rinsing-cap element into said second position to make a flow connection.

4. The apparatus of claim 2, wherein said rinsing-cap element is permanently connected to said first coupling, wherein said rinsing-cap element is configured to swivel on said first coupling, wherein said rising-cap element swivels about said swivel-element axis, and wherein said swivel-element axis is vertical.

5. The apparatus of claim 2, further comprising a collector channel formed on one of said rotor and said machine rack, wherein, in said second position, said collector channel, said first couplings and said outflow channels of said rinsing-cap elements are connected, and wherein said connector channel connects to a fixed discharge during CIP cleaning.

6. The apparatus of claim 2, further comprising a ring enclosing said machine axis, wherein said first coupling is one of a plurality of first couplings, all of which are disposed on said ring.

7. The apparatus of claim 2, further comprising a ring enclosing said machine axis, wherein said first coupling is one of a plurality of first couplings, all of which are formed by said ring.

8. The apparatus of claim 2, further comprising second couplings, wherein, during CIP cleaning, said second couplings connect said first couplings to said fixed discharge, wherein said second couplings swivel between an ineffective position and a working position, wherein, in said ineffective position, said second couplings are outside of a movement space of said first couplings that are moved with said rotor, and wherein in said working position, said second couplings are connected to said first couplings and to said fixed discharge.

9. The apparatus of claim 1, further comprising a container carrier provided on said swiveling element, wherein said container carrier suspends said container.

10. The apparatus of claim 1, wherein said rinsing-cap element comprises a pipe section, wherein said pipe section comprises said outflow channel, and wherein said rinsing cap and said connector are formed on opposite areas of a circumferential wall of said rinsing-cap element.

11. The apparatus of claim 1, wherein said rinsing-cap elements are disposed to rotate with said rotor.

12. The apparatus of claim 1, wherein said rinsing-cap elements are disposed on said machine rack.

13. The apparatus of claim 1, further comprising a container carrier provided on said swiveling element, wherein said container carrier suspends said container.

14. The apparatus of claim 1, wherein said swiveling element comprises a bolt.

15. The apparatus of claim 1, wherein said swiveling element comprises a rod.

16. The apparatus of claim 1, wherein each of said rinsing-cap elements is configured to swivel about said swivel axis such that in said second position, a longitudinal extension of said rinsing-cap element extends radially from said machine axis.

17. The apparatus of claim 1, further comprising a container carrier, wherein said container carrier swivels with said rinsing-cap element, wherein said container carrier swivels between an effective position and an ineffective position, and wherein in said effective position, said container carrier holds a container.

* * * * *